United States Patent [19]

Platt et al.

[11] 4,137,736

[45] Feb. 6, 1979

[54] DOUBLE ACTING AGITATOR WITH CLOTHES LIFTING CAMS

[75] Inventors: Clark I. Platt; Howard D. Merchant, both of St. Joseph, Mich.

[73] Assignee: Whirlpool Corporation, Benton Harbor, Mich.

[21] Appl. No.: 839,998

[22] Filed: Oct. 6, 1977

[51] Int. Cl.[2] ..... D06F 13/00; D06F 17/10

[52] U.S. Cl. ..... 68/134

[58] Field of Search ..... 8/159; 68/131–134, 68/53, 54

[56] References Cited

U.S. PATENT DOCUMENTS

| | | | |
|---|---|---|---|
| Re. 18,280 | 12/1931 | Kirby | 68/133 |
| D. 100,861 | 8/1936 | Hume | D15/57 |
| D. 105,517 | 8/1937 | Geldhof | D248/283 |
| D. 127,576 | 6/1941 | Barber | 68/54 X |
| 1,543,323 | 6/1925 | Dehle | 68/134 |
| 1,629,391 | 5/1927 | Kemp et al. | 68/134 X |
| 1,632,866 | 6/1927 | Altorfer | 68/133 |
| 1,665,959 | 4/1928 | Graham et al. | 68/133 X |
| 1,688,031 | 10/1928 | Altorfer | 68/133 |
| 1,754,626 | 4/1930 | Holzhausen | 68/134 |
| 3,987,651 | 10/1976 | Platt | 68/133 |
| 3,987,652 | 10/1976 | Ruble | 68/134 |

FOREIGN PATENT DOCUMENTS 1020189 11/1952 France.

*Primary Examiner*—Philip R. Coe

*Attorney, Agent, or Firm*—Hill, Gross, Simpson, Van Santen, Steadman, Chiara & Simpson

[57] ABSTRACT

An agitator for a vertical axis automatic clothes washing machine has an upper, auger portion which is rotatable in one direction about the vertical axis. A lower portion of the agitator oscillates in two directions. The lower portion has a skirt and carries radially-extending vanes on an upper surface thereof. A plurality of crescent-shaped, lobe-like lifting cams project outwardly and upwardly from a periphery of the skirt. Fabric articles contacted by the cam surfaces as the lower portion of the agitator oscillates to and fro during clothes washing are continuously lifted at the lower, outer portion of the wash basket and urged along a desired toroidal rollover path. The effective, high density washing action provided permits use of less hot water, rinse water, and detergent than in previously known agitation devices, and allows use of a small machine container for normal wash loads.

7 Claims, 5 Drawing Figures

DOUBLE ACTING AGITATOR WITH CLOTHES LIFTING CAMS

BACKGROUND OF THE INVENTION

1. Field of the Invention

The present invention relates to automatic washing machines employing vertical axis agitators which provide a toroidal rollover motion to clothes and wash fluid within the machine, and is particularly pertinent to double acting agitator constructions using upper, auger portions as well as lower, oscillating portions.

2. The Prior Art

It has been discovered that a very efficient movement pattern for clothes within an automatic washing machine of the vertical axis agitator type is one of toroidal rollover. The prior art is exemplified by U.S. Pat. Nos. 3,987,508, 3,987,651 and 3,987,652, all issued to the assignee of the present application. Such rollover action is accomplished by urging clothes down the agitator barrel along a unidirectionally rotating auger portion, radially outwardly along oscillating agitator vanes in the lower portion of the wash receptacle, upwardly along the wall of the wash receptacle, and inwardly to the barrel at the surface of the wash fluid, forming a toroidal pattern in the wash zone and washing liquid. When the washing basket is heavily loaded with clothes the load crowds the agitator in the basket and may affect adversely the achievement of a full rollover action. With conventional agitators not having any rollover augmentation features only the bottom portion of the tightly packed load is scrubbed, resulting in a very poor and uneven cleaning action.

U.S. Pat. Nos. 1,543,323, 1,688,031 and 1,754,626 disclose automatic washing machines having raised rims on oscillating circular skirts. U.S. Pat. Nos. 1,629,391 and Re. 18,280 show non-oscillating flow deflectors in the bottom of wash receptacles of automatic washing machines. U.S. Pat. Nos. 1,632,866, 1,665,959, Des. 100,861, Des. 105,517, and Des. 127,576, and French Pat. No. 1,020,189 show agitators having generally circular skirts with upward convolutions in the circumferential direction thereon.

A prior art agitator device had a skirt portion and generally upright vanes having a wavy configuration throughout their vertical extent. Attached to a chordal section of the agitator skirt between each of the upright vanes was a flat or planar, crescent-shaped cam. Oscillation of the agitator and the crescent-shaped cams thereon in a body of water produced some additional agitation, the added agitation being directed generally in a vertical direction.

SUMMARY OF THE INVENTION

A double acting agitator having an upstanding auger portion for unidirectional rotation and a lower, radially-vaned portion for rotational oscillation is mounted inside a wash receptacle about a vertical axis. A plurality of substantially crescent-shaped cams are attached to a perimeter of a skirt of the lower agitator portion and extend outwardly and upwardly therefrom above a bottom wall of the receptacle. Each crescent-shaped cam has a convex free edge portion which engages and lifts or cams the fabrics upwardly during each oscillation of the lower agitator portion. Addition of the lifting cams so enhances washing action of the double acting machine agitator that a very high ratio of articles to wash liquid can be used. The high density action allows use of less water and detergent and even a smaller machine for normal loads of clothes.

THE DRAWINGS

THE PREFERRED EMBODIMENTS

Figure 1:
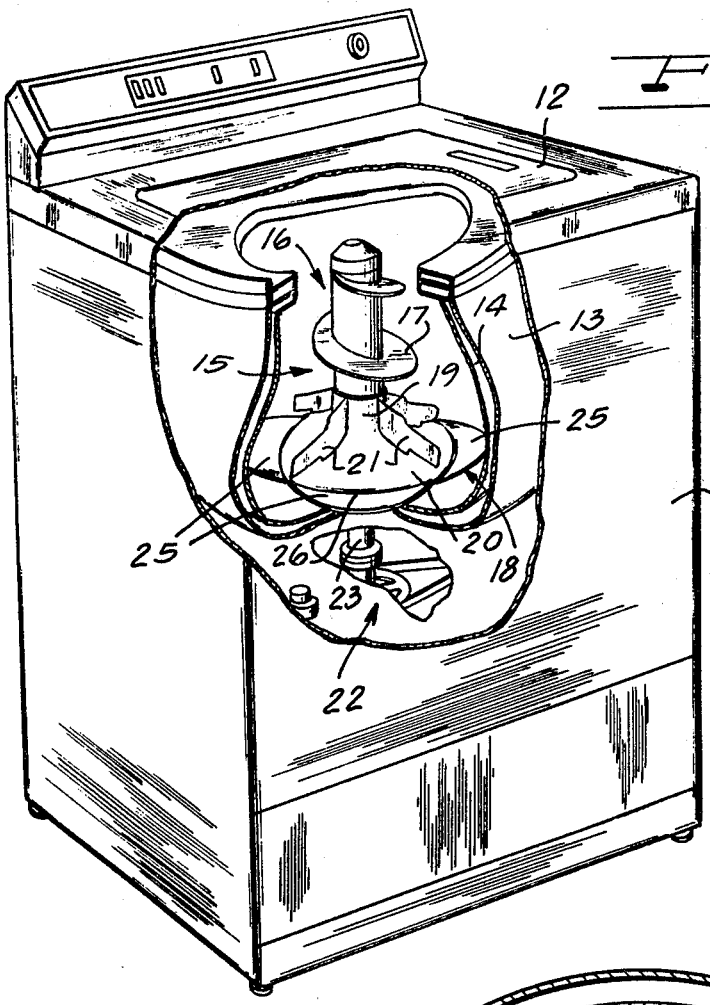
FIG. 1 is a perspective view of a washing machine with portions of the cabinet cut away to show the wash receptacle, agitator and other internal parts thereof.

A washing machine 10 of the automatic, vertical axis type, shown generally in FIG. 1, comprises a cabinet 11 having a hinged lid 12 for permitting access to the interior of the machine. An imperforate fluid retaining tub 13 and a perforate washing receptacle or basket 14 are mounted coaxially within the cabinet 11. An agitator assembly 15 is mounted coaxially within the tub 13 and basket 14.

The agitator 15 comprises an upper auger portion 16 with a helical vane 17 carried thereon and a lower, oscillating portion 18 having a center post 19, a skirt 20 and a plurality of fluid handling and scrubbing vanes 21 mounted in radial and vertical relation on the center post 19 and the skirt 20. Each vane 21 is attached to the center post 19 and to the skirt 20 over about half its radial length, with the outer half thereof spaced slightly above the skirt 20 to be somewhat flexible. A driving means 22 comprises a motor and belt and pulley arrangement partly shown in the drawing for driving a vertically oriented shaft 23 in sequential oscillatory motions during a washing cycle. The drive shaft 23 is connected directly to the lower agitator portion 18 and through a one-way clutch arrangement to the upper auger portion 16, in the manner of the Ruble U.S. Pat. No. 3,987,652, to convert the oscillations to a one-way, unidirectional rotation.

In accordance with the invention, each of the several crescent-shaped lifting cams 25 is affixed to a peripheral rim 26 of the agitator skirt 20 between circumferentially-adjacent vanes 21. The individual cams 25 are each geometrically defined between edge lines 27, 28 forming a portion of the area of a cone, the larger-radius line 27 having the same radius as the periphery 26 of the agitator skirt 20. The lower edge 27 of each lifting cam 25 is thus co-linear with the circular periphery 26 of the skirt 20. The free upper or outer edge 28 of each lifting cam 25 has a somewhat smaller radius. In one structural embodiment of the invention, where the agitator skirt periphery 26 has a radius of 158mm, the radius of the upper edge of the cams 25 is 127mm (6.2 and 4.95 inches, respectively). The two edges 27, 28 join at the periphery 26 of the skirt 20 is cusped ends at 29, 29 on each cam 25.

Figure 2:
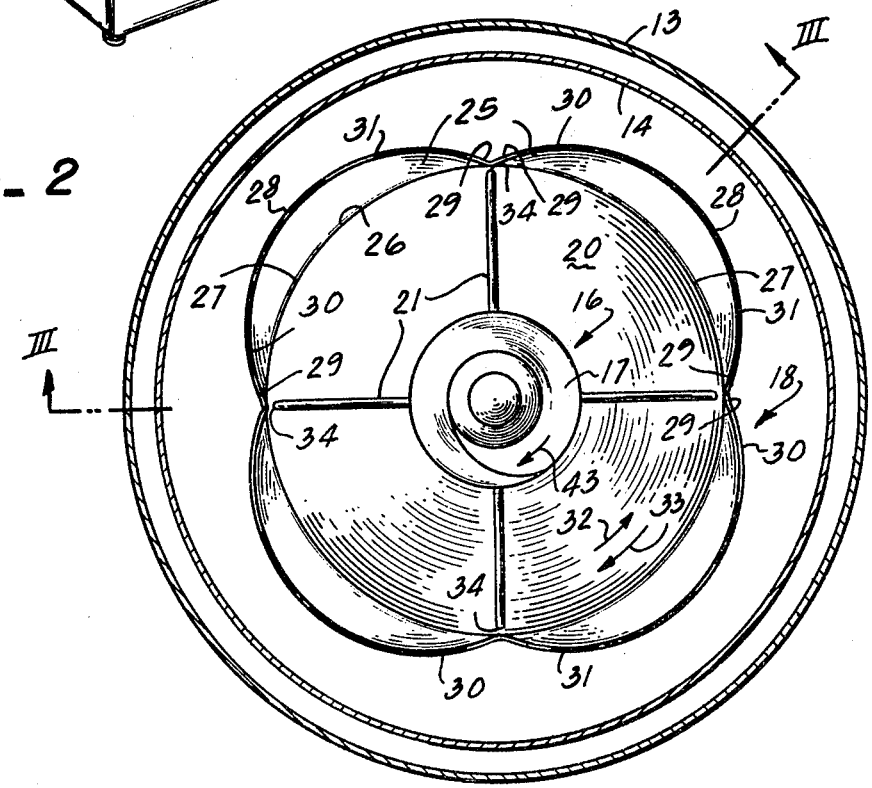
FIG. 2 is a top, plan view of a double acting agitator with camming surfaces, and with the wash receptacle thereabout.
Figure 3:
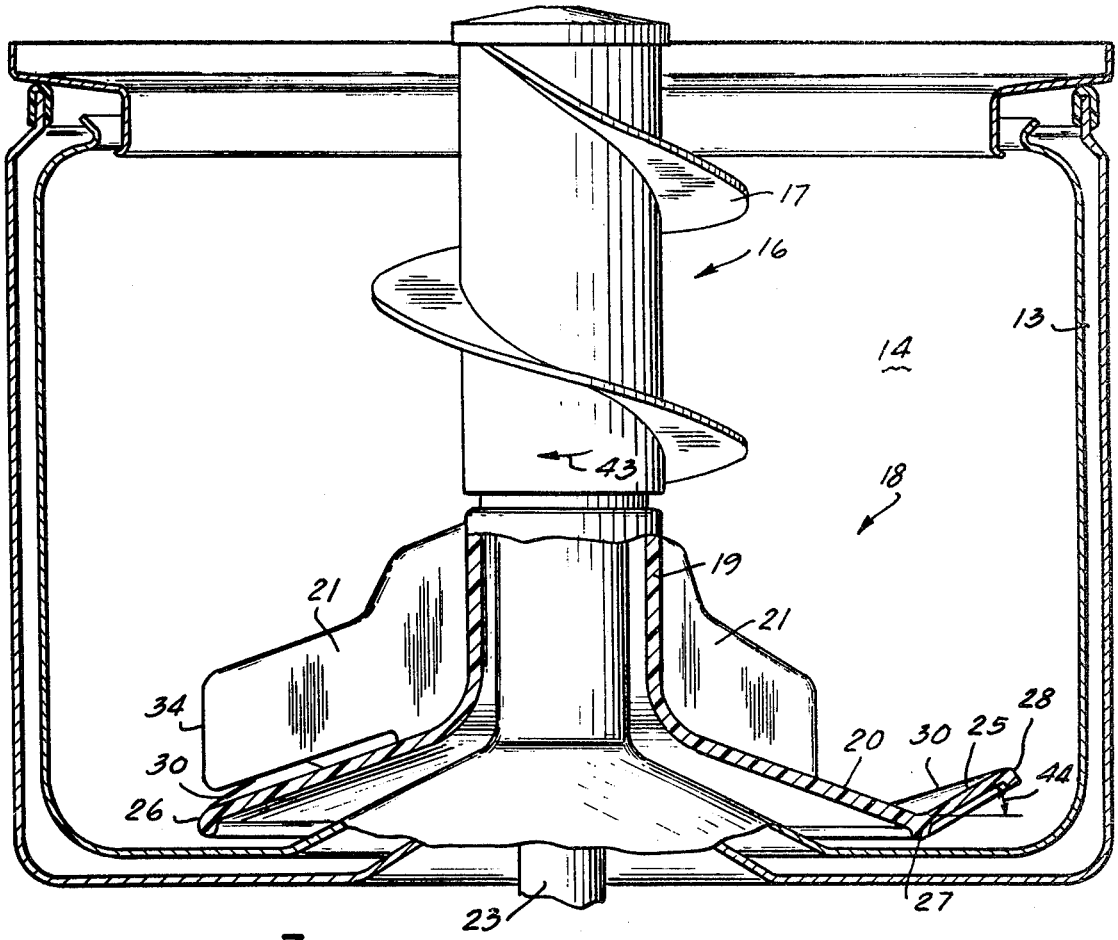
FIG. 3 is a side, partly sectional view through the agitator and wash receptacle, taken on line III—III of FIG. 2.
Figure 4:
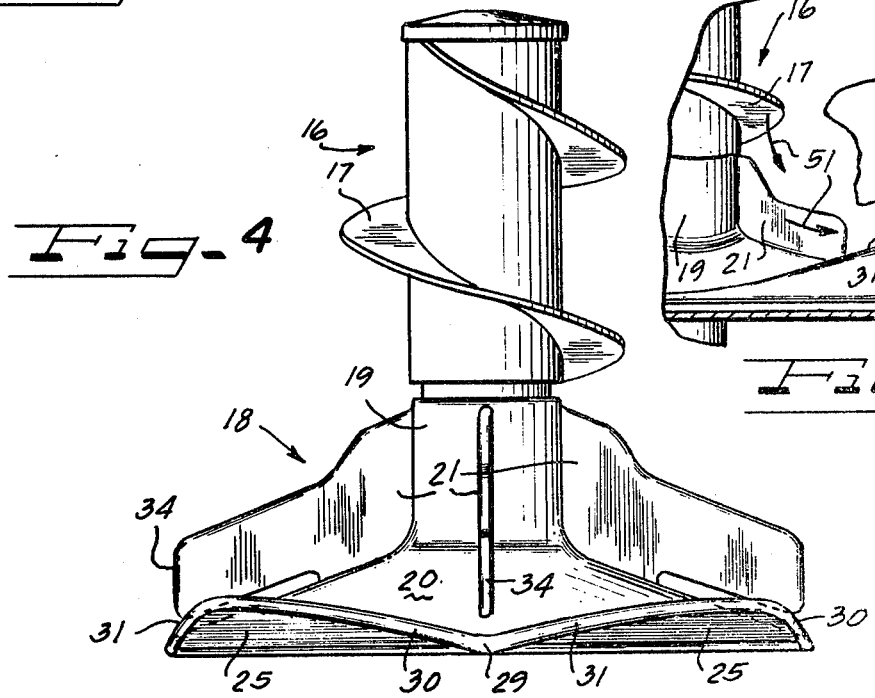
FIG. 4 is a side elevational view of a double acting agitator with cams of the present invention.

Each lifting cam 25 is symmetric about a line bisecting the angle between two adjacent vanes 21. Then each upper edge 28 of each vane 25 provides alternating leading and trailing edge portions 30, 31 about the periphery of the lower agitator 18 for a counterclockwise direction of rotation 32 as in FIG. 2. Upon a reverse oscillation 33, the functions of the edge portions 30, 31 reverse. To insure full camming action in the embodiment shown, each free edge 28 joins the periphery 26 of the agitator skirt 20 circumferentially adjacent each vane 21. Each vane 21 also terminates radially outwardly of the axis of the agitator 15 at an edge 34 located inwardly of the perimeter 26 of the skirt 20. Such termination position reduces interference between the actions of vanes 21 and the cams 25.

Further, the oscillation of the lower agitator portion 18 physically deflects the articles of clothing upwardly and outwardly at the upward angle 44 from the horizontal by the camming effect of the leading and trailing edges 30, 31 of the cams 25. The inclination of angle 44 is approximately 33° and has been found effective. This angle to the cam lobes 25 provides good lift for augmentation of rollover without excessively increasing torque requirements for the agitator drive 22. The greater the volume swept out by the cams, the greater the torque absorbed in fluid and clothes handling by the cams.

As shown in the figures, the lower agitator portion 18 is sized and spaced within the wash receptacle or basket 14 with a clearance of several inches between the free outer edges 28 of the lifting cams 25 and a vertical wall 45 of the basket 14. Such clearance of the cams, which extend radially outwardly beyond the skirt periphery and the vertically extending agitator vanes 21, gives good, sweeping coverage of the outer portion of the bottom of the washing basket 14 yet avoids pinching the clothes between the cam edges 28 and the basket wall 45. In one embodiment which has good results, a 63.5mm (2½ inch) radial clearance was employed.

Figure 5:
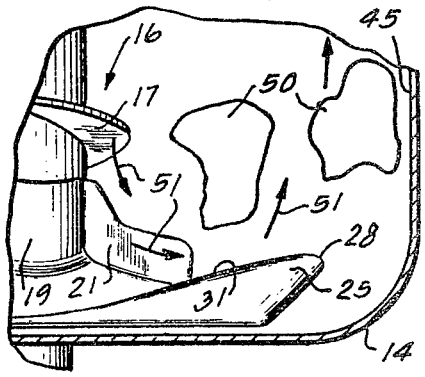
FIG. 5 is an enlarged, detail view of a lower portion of the wash receptacle showing toroidal movement imparted to articles of clothing including lifting movement by the lifting cams.

In operation, articles of clothing 50 are placed within the wash basket 14 about the agitator 15. The basket 14 and the tub 13 are filled with wash liquid. As shown by the arrows 51 in FIG. 5, the wash fluid and the articles of clothing 50 are urged positively through a toroidal rollover pattern. As the upper auger portion 16 rotates unidirectionally, the helical vane 17 urges the clothing and wash fluid downwardly in the center of the basket 14. Oscillation of the vanes 21 in to and fro motions 32, 33 urges the articles of clothing 50 outwardly at the bottom of the clothes basket 14. The effect of the lifting cams 25 increase the outward urging of the clothes 50. The articles 50 are also cammed upwardly by the upper surfaces 41 of the cams 25 as well as the upper, free edges 28 thereon. Downward, outward, and upward displacements of the articles 50 act on other articles within the basket 14, causing them also to move in the toroidal rollover path.

Even if the load of clothing articles 45 within the basket 14 is extremely heavy, the positive lifting action of the cams 25 assures positive rollover of the entire load in the machine. Thus less hot and rinse water and detergent can be used than in prior art machines. Machines employing the present invention to achieve such high density washing action may even be redesigned to be smaller than prior art machines.

Although various minor modifications may be suggested by those versed in the art, it should be understood that we wish to embody within the scope of the patent warranted hereon all such modifications as reasonably and properly come within the scope of our contributions to the art.

The embodiments of the invention in which an exclusive property or privilege is claimed are defined as follows:

1. A double acting atitator for an automatic washing machine having a vertical axis, the agitator comprising:

an upper agitator element mounted for unidirectional rotation and carrying at least one helical vane thereon to urge clothing and wash fluid downwardly;

a lower agitator element mounted below and coaxially with the upper agitator element and comprising a skirt having a circular peripheral rim and a plurality of radially-extending circumferentially spaced vanes carried on and about said skirt to impel clothing and wash fluid radially outwardly; and a plurality of crescent-shaped lifting cam members colinearly attached to and extending outwardly and upwardly from said rim of said skirt at an angle to the horizontal, each said cam member being geometrically defined between edge lines forming a portion of the area of a cone, the upper edge of each said cam member providing alternating leading and trailing edge portions to physically deflect and impel clothing upwardly and outwardly upon oscillation, whereby the agitator elements and the cam members impel fabrics into a rollover pattern during operation of the agitator.

2. An agitator assembly as defined in claim 1, wherein each cam member is upwardly inclined at an angle of approximately 33° with respect to the horizontal.

3. An agitator assembly as defined in claim 1, wherein each crescent-shaped cam member has cusped ends terminating at the rim of the skirt, thereby to facilitate lifting of the articles as the lower agitator portion oscillates.

4. An agitator assembly as defined in claim 1, wherein the lower agitator element carries at least three of said vane means spaced apart circumferentially of the skirt, and wherein each of said crescent-shaped cam members is disposed between an adjacent pair of vane means.

5. An agitator assembly as defined in claim 1, wherein the lower agitator element carries four of said vanes and of said cam members, the centers of which are spaced approximately 90° apart about the circumference of the skirt.

6. An apparatus for obtaining and assuring toroidal rollover movement of heavy loads of fabric articles and wash fluid in a wash receptacle of an automatic, vertical axis washing machine having a two-piece agitator having an upper, unidirectionally rotatable part and a lower, oscillatible part carrying a skirt thereon, the apparatus comprising:

means for impelling wash fluid and articles axially downwardly in a center portion of the wash receptacle outwardly of said auger portion;

means for impelling the wash fluid and articles radially outwardly in a bottom portion of the wash receptacle; and means for camming articles upwardly on both forward and reverse oscillations of the lower part of the agitator in a region radially outwardly of the agitator skirt and spaced adjacent a wall of the wash receptacle, said means for camming articles upwardly comprising a plurality of cam lift members affixed to the outer perimeter of said skirt, each of said cam lift members comprising a generally crescent-shaped surface forming portions of the surface of a cone coaxial with the agitator and having a radially inner edge co-linear with the perimeter of the skirt, and an outer edge raised above the level of the perimeter of the skirt and extending from points spaced circumferentially apart from one another.

7. An apparatus as defined in claim 6 and further characterized by said means for impelling the wash fluid and articles radially outwardly comprising a plurality of flexible vanes overlying but separated from the skirt for impelling the wash fluid and articles radially outwardly.

* * * * *